US005528817A

United States Patent [19]

Klappert et al.

[11] Patent Number: 5,528,817

[45] Date of Patent: Jun. 25, 1996

[54] APPARATUS FOR MAKING PACKETS OF AMORPHOUS STEEL STRIP FOR TRANSFORMER CORE MANUFACTURE

[75] Inventors: Willi Klappert; David R. Freeman, both of Hickory, N.C.

[73] Assignee: General Electric Company, Plainville, Conn.

[21] Appl. No.: 239,784

[22] Filed: May 9, 1994

Related U.S. Application Data

[62] Division of Ser. No. 904,428, Jun. 26, 1992, Pat. No. 5,347,706.

[51] Int. Cl.[6] ..... H01F 41/00

[52] U.S. Cl. ..... 29/564.6; 29/564.8; 29/609; 29/738; 83/636

[58] Field of Search ..... 29/605, 609, 606, 29/738, 564.6, 564.8; 83/636

[56] References Cited

U.S. PATENT DOCUMENTS 5,050,294 9/1991 Ballard et al. ..... 29/609
5,063,654 11/1991 Klappert et al. ..... 29/609
5,093,981 3/1992 Ballard et al. ..... 29/609
5,329,270 7/1994 Freeman ..... 336/213

*Primary Examiner*—Carl E. Hall
*Attorney, Agent, or Firm*—Carl B. Horton; William Freedman

[57] ABSTRACT

This method of making packets of amorphous metal strip adapted to be wrapped about the arbor of a transformer-core-making machine comprises providing first and second composite strips, each comprising many thin layers of amorphous metal strip stacked in superposed relationship. The composite strips have leading ends that are located in initial positions (i) axially spaced from each other at the start of a packet-making operation and (ii) at opposite ends of a stacking zone where the packets are built up during a packet-making operation. The composite strips are cut to detach first sections of strip from the first composite strip and to detach second sections of strip from the second composite strip; and the detached sections are axially advanced forwardly of the respective composite strips from which they are detached into said stacking zone. The second sections are stacked in alternating relationship upon the first sections in the stacking zone.

5 Claims, 7 Drawing Sheets

TIMING DIAGRAM FOR DOUBLE MECHANISM APPARATUS

| MECHANISM 19 | | | | | | | | |
|---|---|---|---|---|---|---|---|---|
| CAR CLAMP 22 PULLS | | | | | | | | |
| BLADES 16,18 SHEAR | | | | | | | | |
| JAWS 14, 14a FEED | | | | | | | | |
| CAR CLAMP 22 STACKS | | | | | | | | |
| CAR CLAMP 22 RELEASES | | | | | | | | |
| CAR CLAMP 22 RETURNS HOME | | | | | | | | |
| CAR CLAMP 22 GRASPS | | | | | | | | |

| MECHANISM 119 | | | | | | | | |
|---|---|---|---|---|---|---|---|---|
| CAR CLAMP 122 RETURNS HOME | | | | | | | | |
| CAR CLAMP 122 GRASPS | | | | | | | | |
| CAR CLAMP 122 PULLS | | | | | | | | |
| BLADES 116,118 SHEAR | | | | | | | | |
| JAWS 114, 114a FEED | | | | | | | | |
| CAR CLAMP 122 STACKS | | | | | | | | |
| CAR CLAMP 122 RELEASES | | | | | | | | |
| TIME (SEC) | 1.2 | 1.2 | .6 | 1.2 | 1.2 | 1.2 | .6 | 1.2 |

CYCLE TIME = 8.4 SECONDS (TWO SECTIONS CUT AND STACKED)

| COLUMN #1 | #2 | #3 | #4 | #5 | #6 | #7 | #8 | #9 |
|---|---|---|---|---|---|---|---|---|

*Fig. 9*

APPARATUS FOR MAKING PACKETS OF AMORPHOUS STEEL STRIP FOR TRANSFORMER CORE MANUFACTURE

CROSS-REFERENCE TO RELATED PATENTS

This is a division of application Ser. No. 07/904,428, filed Jun. 26, 1992 and issued as U.S. Pat. No. 5,347,706.

This application is related to the subject matter disclosed and claimed in the following patents, all of which are incorporated by reference in the present application:

Klappert and Freeman U.S. Pat. No. 5,063,654, issued Nov. 12, 1991

Klappert and Ballard U.S. Pat. No. 5,093,981, issued Mar. 10, 1992

Ballard and Klappert U.S. Pat. No. 5,050,294, issued Sep. 24, 1991

Also incorporated by reference herein is the following application: Freeman application Ser. No. 07/904,746, filed Jun. 26, 1992, which has issued as U.S. Pat. No. 5,329,270.

TECHNICAL FIELD

This invention relates to a method of making packets of amorphous steel strip that are adapted to be wrapped about the arbor of a transformer-core-making machine. The invention also relates to apparatus for making such packets.

BACKGROUND

In each of the above U.S. Pat. Nos. 5,063,654 and 5,093,981 there is disclosed and claimed a method of making amorphous steel cores for transformers that involves making up packets of amorphous steel strip and then wrapping these packets about an arbor to build up a core form. When the core form is removed from the arbor, it has a window where the arbor was located, and the packets surround this window. Each packet comprises a plurality of groups of amorphous steel strip, and each group comprises many thin layers of such strip.

In the aforesaid U.S. Pat. No. 5,063,654, the groups from which the packets are assembled are derived from a single composite strip comprising many thin layers of amorphous steel strip stacked in superposed relationship. This composite strip is cut into sections of controlled length; two of these sections are stacked together to form a group, and the groups are stacked one upon the other to form a packet.

The method of U.S. Pat. No. 5,063,654 is relatively fast in operation and simple to implement because it assembles each packet and its constituent groups in a stacking location that is axially aligned with the composite strip from which the groups are derived. This is in distinct contrast to the method of U.S. Pat. No. 5,093,981, where each section of composite strip after being cut to length and axially advanced to a predetermined position, is transported laterally to a stacking location on a carrier. Laterally transporting the sections to their stacking location is a time-consuming operation and, moreover, requires relatively complicated apparatus for its implementation.

OBJECTS

An object of our present invention is to provide a method of making the packets that requires no lateral transportation of the sections or groups of amorphous steel strip but which is substantially faster than our above-described method of U.S. Pat. No. 5,063,654.

Another object is (i) to derive the multi-layer sections from which the groups and packets are built up from two separate composite strips, (ii) to utilize two inter-related mechanisms for respectively handling the two composite strips and the sections derived therefrom, and (iii) to operate these mechanisms concurrently so as to reduce the effect of otherwise unproductive intervals when one or the other of the mechanisms is being reset in preparation for another operating cycle.

SUMMARY

In carrying out the invention in one form, we provide first and second composite strips, each comprising many thin layers of amorphous steel strip stacked in superposed relationship, the composite strips having leading ends that are located in initial positions that are axially spaced from each other at the start of a packet-making operation. These initial positions are at opposite ends of a stacking zone on a supporting surface where the packets are built up during a packet-making operation. We begin our method by advancing the leading end of the first composite strip from its initial position in a first-strip forward direction, and then we cut the first composite strip at a first cutting location spaced rearwardly of the leading edge of the first composite strip, thereby detaching from the first composite strip a first section of multi-layer strip and creating a new leading end of the first composite strip just behind the first cutting location. Then, we axially advance the first detached section to a position axially spaced from the first cutting location and within the stacking zone. These advancing steps are performed with first transport means that is moved from a home position in a first-strip forward direction during the advancing steps and is thereafter returned to said home position in preparation for advancing the new leading end of the first strip in a first-strip forward direction.

While the first transport means is being returned to its home position, the leading end of the second composite strip is advanced from its initial position in a second-strip forward direction that is opposite to the first-strip forward direction. Then the second composite strip is cut at a second cutting location spaced rearwardly of the leading edge of the second composite strip, thereby detaching from the leading end of the second composite strip a second section and also creating a new leading end of the second composite strip just behind the second cutting location. Then the second section is advanced in a second-strip forward direction into a position within the stacking zone atop the first detached section. These latter advancing steps are performed with second transport means that is moved from its own home position in said second-strip forward direction during the latter advancing steps and is thereafter returned to its home position in preparation for advancing the new leading end of the second strip in a second-strip forward direction.

While the second transport means is being returned to its home position, the first transport means is advancing the leading end of the first composite strip in preparation for another cutting operation of the first composite strip.

The above-defined cycles of operation are repeated over and over again, thus deriving from the two composite strips additional sections of controlled length, which are stacked upon the first two sections in the stacking zone, thereby building up a packet of the desired thickness when a predetermined number of these sections have been stacked.

In addition to the above-summarized method, we claim in this application apparatus for carrying out the method.

BRIEF DESCRIPTION OF DRAWINGS

For a better understanding of the invention, reference may be had to the following detailed description taken in connection with the accompanying drawings, wherein:

FIGS. 1*a* and 1*b* taken together are referred to in this specification as FIG. 1.

FIGS. 2*a* and 2*b* taken together are referred to in this specification as FIG. 2.

In FIG. 3 the depicted parent composite strip has been advanced to a position where it is ready to be cut by the shear blades to detach a section therefrom.

FIG. 9 is a timing diagram showing the sequence and timing of the various operations performed by the apparatus of FIGS. 1–5.

DETAILED DESCRIPTION OF EMBODIMENT

Figure 6:
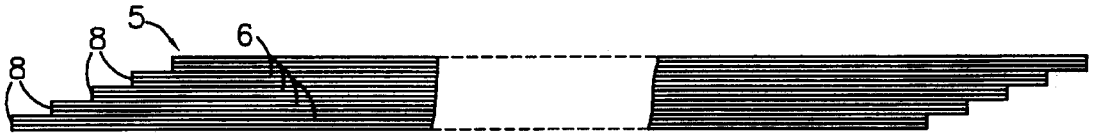
FIG. 6 is a side view of a packet of amorphous steel strip that is made by the method of our invention.
Figure 7:
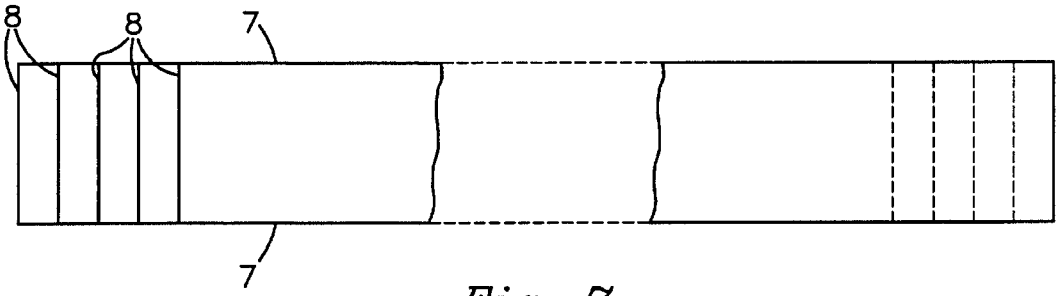
FIG. 7 is a top plan view of the packet of FIG. 6.

The Packet of FIGS. 6 and 7

Referring first to FIGS. 6 and 7, there is shown a packet 5 of amorphous steel strip which is representative of the many packets that are manufactured by the method of our invention. This packet comprises a plurality of groups 6 of amorphous steel strip, each group comprising many thin layers of elongated strip. In each group, the layers of strip have longitudinally-extending edges 7 at opposite sides thereof and transversely-extending edges 8 at opposite ends thereof. In each group the longitudinally-extending edges 7 of the strips at each side of the group are aligned, and the-transversely-extending edges 8 of the strips at each end of the group are in near alignment.

In the packet of FIGS. 6 and 7, the groups 6 are made progressively longer beginning at the bottom (or inside) of the packet and proceeding toward the top (or outside) of the packet. This increased length enables the groups to completely encircle the increasingly greater circumference of the core form as the core form is built up when the packets are wrapped about an arbor, as is shown, for example, in the aforesaid Klappert et al U.S. Pat. No. 5,093,981. The packets are wrapped about the arbor with their inside, or shortest, group nearest the arbor.

Referring still to FIGS. 6 and 7, adjacent groups in each packet have their transversely-extending ends staggered so that at one end of the packet the adjacent groups underlap, and at the other end of the packet the adjacent groups overlap. This staggering results in distributed type joints in the final core after the above-described wrapping about an arbor.

Figure 1A:
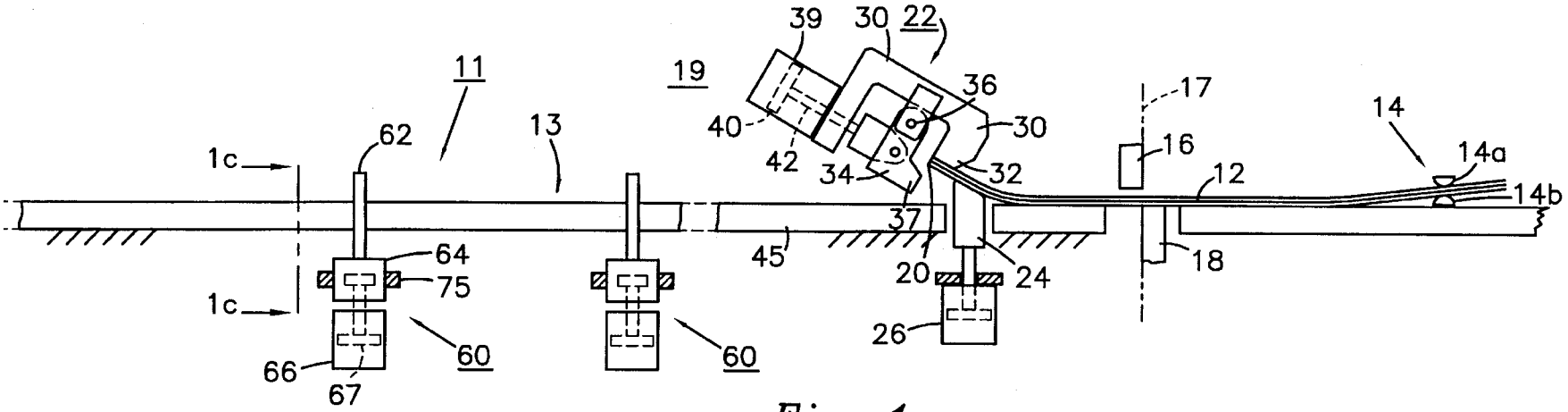
FIGS. 1*a* and 1*b* taken together constitute a schematic side-elevational view of apparatus used in practicing one form of our invention. This side elevational view is spread over two sheets of the drawings, FIG. 1*a* appearing on one sheet and FIG. 1*b*, on the other. The apparatus in FIGS. 1*a* and 1*b* is depicted in a state where the leading edge of each of the two composite strips has been advanced beyond the shear blades, but before either composite strip has been advanced to a position where the first section of strip is cut therefrom by the shear blades.
Figure 2A:
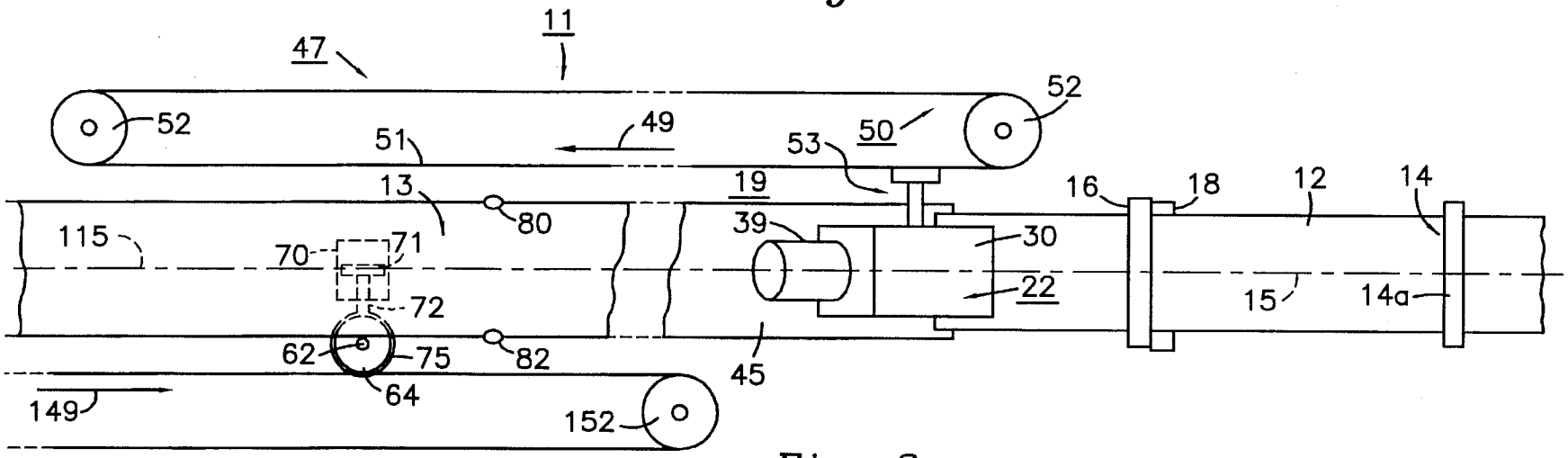
FIG. 2*a* is a top plan view of the portion of the apparatus of FIG. 1*a*.
Figure 1B:
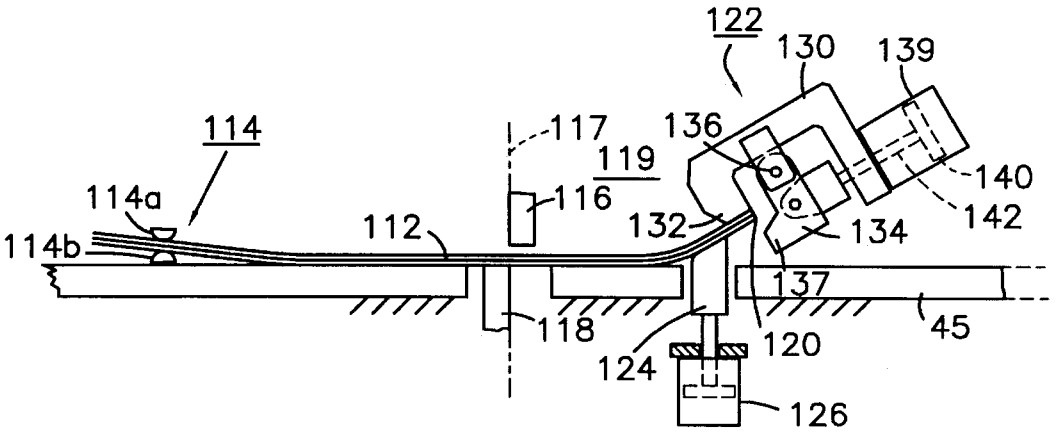
Figure 2B:
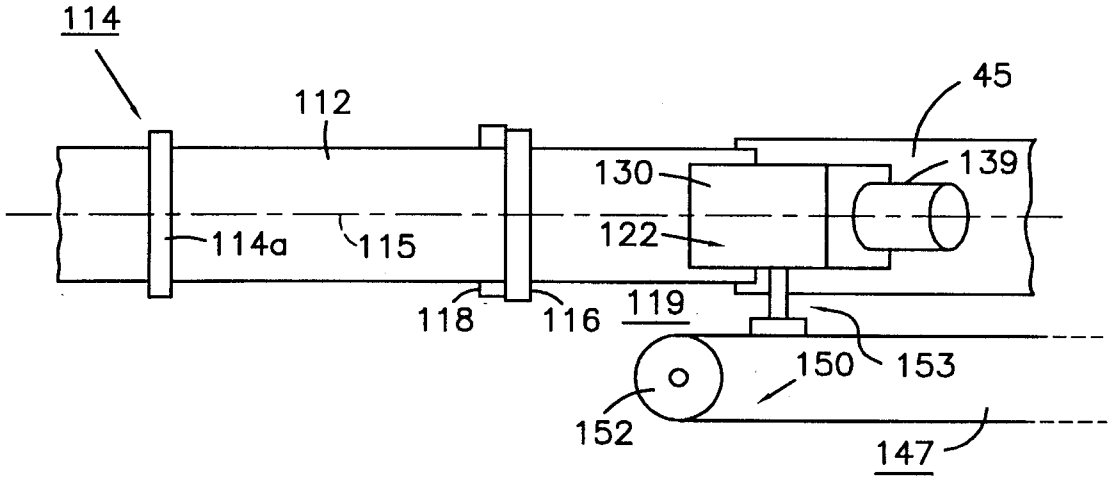
FIG. 2*b* is a top plan view of the portion of the apparatus of FIG. 1*b*.

The Composite Strips 12 and 112 from Which the Groups 6 and Packets 5 Are Derived Referring now to FIGS. 1 and 2, we show two composite Strips 12 and 112 of amorphous steel strip from which we derive the above-described groups 6 that are used for constructing each packet 5. Each of these composite strips 12 and 112 comprises many thin layers of amorphous steel strip stacked in superposed relationship, with the longitudinal edges at each side of the layers disposed in substantially aligned relationship. The apparatus for deriving the packet components and for building up packets from these components is generally designated 11. The packets are built up during a packet-making operation in a stacking zone 13 atop a stationary supporting table 45. As shown in FIGS. 1 and 2, at the start of a packet-making operation, the leading ends of the two composite strips 12 and 112 are located in initial positions that are spaced apart axially, or lengthwise, of the two composite strips and at opposite ends of the stacking zone 13. As further shown in FIG. 2, the leading ends of the composite strips 12 and 112 have their central longitudinal axes 15 and 115 substantially aligned.

Figure 8:
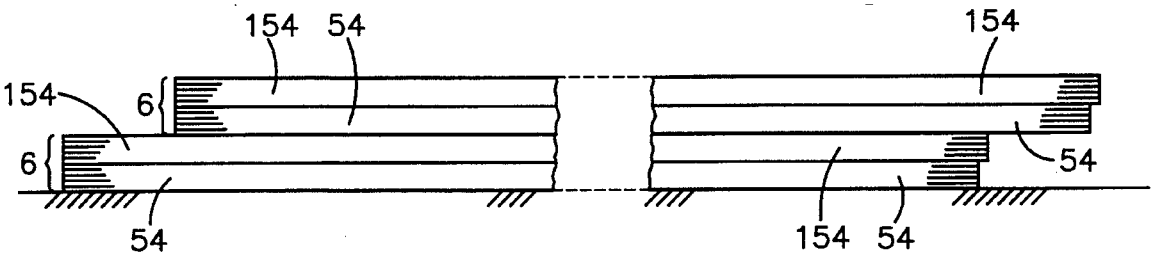
FIG. 8 is an enlarged side elevational view of a portion of a packet comprising two superposed groups 6, each comprising two sections 54 and 154 stacked together.

Each Group is Normally Constructed from Multi-Layer Sections 54 and 154 Stacked Together, and a Packet 5 Is Constructed from Groups Stacked Together In the illustrated form of the invention, best illustrated in FIG. 8, each group 6 is made up from two multi-layer sections (54 and 154) of amorphous steel strip stacked in superposed relationship, with the longitudinally-extending edges at each side of the two sections in substantial alignment and their transversely-extending edges at opposite ends of the sections in near alignment. Normally, the two sections 54 and 154 constituting each group are respectively derived from the two composite strips 12 and 112. More specifically, a first section 54 is cut from the leading end of composite strip 12 and is advanced in a first-strip forward direction into the stacking zone 13, where it is clamped to the top of supporting table 45. Thereafter, a second section 154 is cut from the leading end of the other composite strip 112 and is advanced in a second-strip forward direction into the stacking zone 13, where it is placed atop the first section in appropriately aligned relationship and clamped thereto. Additional sections are cut from the composite strips 12 and 112 in the same manner as the first two sections; these additional sections are sequentially fed into the stacking zone 13, where they are stacked upon one another to form an additional group atop the preceding group. Additional groups are made up in the same way and are stacked upon the preceding groups in the stacking location 13 until a packet 5 of the desired thickness has been built up.

The two sections constituting each group may be of the same length; but in a preferred form of our invention, the outer section (154) is made slightly longer than the inner section (54) by an amount equal to $2\pi T$, where T is the thickness of the inner section. The two sections are stacked so that at one end of the resulting group, the edges of the two sections are aligned. At the opposite end of the group the end of the outer section overhangs the end of inner section by an amount $2\pi T$. When such a group is wrapped about the arbor of a corermaking machine, each of the sections develops at one end a beveled edge, and the beveled edge of the outer section overlaps that of the inner section. This type of construction is illustrated in FIG. 8 and is disclosed in more detail and claimed in Freeman application Ser. No. 07/904,746, which is incorporated by reference herein.

Groups made up in the manner disclosed in the immediately-preceding paragraph are stacked in longitudinally staggered relationship to form a packet, and such packets are wrapped about the arbor of a core-making machine to form a core in the same conventional way as the packets of FIGS. 6 and 7 are wrapped.

The Strip-Handling Mechanisms 19 and 119 at Opposite Ends Of The Stacking Zone 13

For cutting sections 54 and 154 of controlled length from the two composite strips 12 and 112 and for advancing these sections into the stacking zone 13 and stacking them upon one another, as briefly described in the immediately-preceding section, two substantially identical strip-handling mechanism 19 and 119 are provided at opposite ends of the stacking zone 13. Corresponding components of these two mechanisms are designated with the same reference numerals, except the reference numerals of the left-hand mechanism include the prefix "1". Since these mechanisms 19 and 119 are substantially identical, only one, the right-hand one 19, will be described in detail. This mechanism, it is noted, operates in essentially the same manner as a correspondingly-designated mechanism in our aforesaid U.S. Pat. No. 5,063,654.

Referring to FIG. 1*a*, composite strip 12 is advanced into its position of FIG. 1*a* by feeding means schematically shown at 14, which has a normal position to the right of that depicted in FIG. 1*a*. When the feeding means is in its normal position, it grips the composite strip between jaws 14*a*, 14*b* and then moves to the left, advancing the composite strip into its position of FIG. 1*a*.

In its position of FIG. 1*a*, the composite strip 12 is positioned between two shear blades 16 and 18, which are relatively movable in a vertical direction to cut the composite strip by a shearing operation. A preferred form of these shear blades is shown and claimed in Taub et al U.S. Pat. No. 4,942,798. The cutting location is along the plane 17 of FIG. 1*a*.

The leading edge 20 of the composite strip 12 is shown in FIG. 1*a* in a position where it can be grasped by first transport means comprising a car clamp 22, which after such grasping moves to the left to further advance the composite strip, as will soon be described in more detail. The leading edge 20 is raised into a position where it can be easily grasped by the car clamp by means of a raise bar 24. This raise bar 24, which is operated by an air cylinder 26, is lifted by the air cylinder when the leading edge 20 is near its position of FIG. 1*a*. After the car clamp 22 has grasped the leading portion of the composite strip 12, the air cylinder 26 lowers the raise bar 24 to a non-interfering position with respect to the composite strip.

The car clamp 22 comprises a C-frame 30 forming a first jaw 32 at one end of the C-frame and an arm 34 pivotally mounted at 36 and forming another jaw 37 at one end of the arm. An air cylinder 39 is carried by the C-frame and comprises a movable piston 40 and a piston rod 42 coupled to the piston and pivotally connected at its lower end to the arm 34. When the piston 40 is operated in a downward direction, it pivots the arm 34 counterclockwise about pivot 36, causing jaw 37 to approach jaw 32, thereby gripping the leading end of the composite strip between the jaws.

The car clamp 22 is positioned a small distance above a supporting table 45 and is movable along the length of the table by indexing means 47 schematically shown in FIG. 2*a*. This indexing means 47, in the illustrated embodiment, comprises a chain and sprocket drive 50 that is capable of advancing its chain 51 (as indicated by arrow 49) along the desired path of movement of the composite strip. The car clamp 22 is mechanically coupled to the chain 51, as shown schematically at 53, so that when the chain is driven by its sprockets 52 in the direction of arrow 49, the car clamp, then grasping the leading portion of the composite strip, advances the composite strip in a first-strip forward direction into the position depicted in FIG. 3. During such advancing motion, the jaws 14*a* and 14*b* of the upstream feeding means are separated and do not grip the composite strip.

Figure 3:
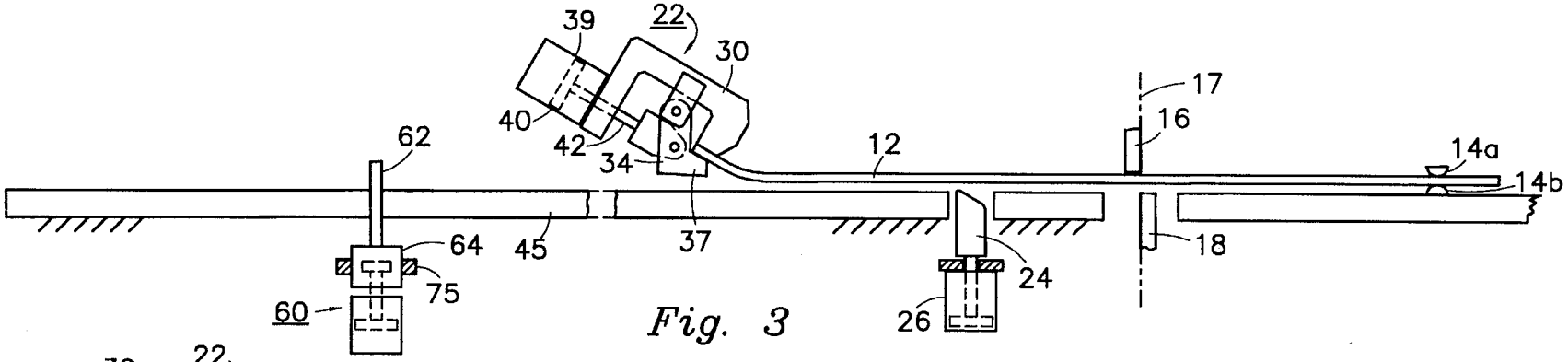
FIG. 3 is another side-elevational view of the apparatus depicted in FIG. 1. Only the FIG. 1*a* portion of the FIG. 1 apparatus is shown in FIG. 3.

When the leading end of the composite strip 12 arrives in its position of FIG. 3, the jaws of the upstream feeding means 14 are operated toward each other to again grip the composite strip so that the strip is held taut between the car clamp 22 and the upstream feeding means, following which a shear-cutting operation is effected by the blades 16 and 18. This cutting operation detaches the leading portion of the composite strip 12 from the remainder of the composite strip, thereby producing a detached section 54 and forming a new leading edge at the cutting location 17 on the remainder of the composite strip.

Advancing the First Detached Section 54 to a Stacking Position on Table 45

Figure 4:
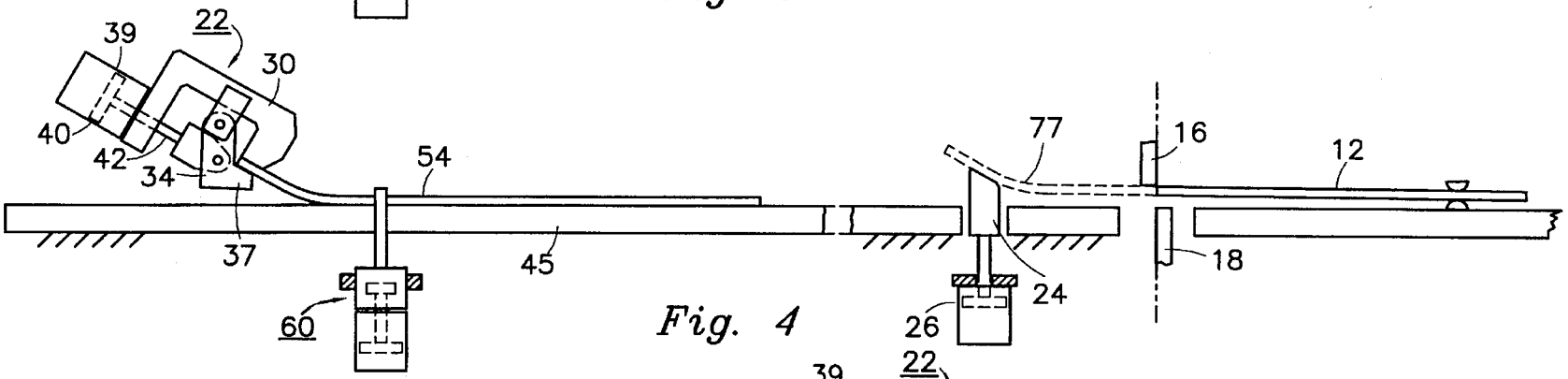
FIG. 4 is still another side-elevational view of the portion of the apparatus depicted in FIG. 1*a*. In this figure a first section of the composite strip, detached from the parent strip by a shear-cutting operation, has been advanced to a stacking position.

When the above shear-cutting operation has been completed, the car clamp 22, which is then grasping the leading end of the detached section 54, is advanced in said first-strip forward direction to its position of FIG. 4, carrying the detached section in an axial, or longitudinal, direction into its stacking position of FIG. 4. This advancing motion of the car clamp 22 is effected by the indexing means 47 driving chain 51 further along the table 45. When the detached section 54 enters its advanced position of FIG. 4, it is clamped to the supporting table 45 by two spaced-apart clamping devices 60, soon to be described. (Both clamping devices are shown in FIG. 1*a*, but, for simplicity, only one is shown in the other figures.) When the clamping devices 60 have thus clamped section 54 to table 45, the car clamp 22 releases the section 54 and is returned to its home position of FIG. 1*a* by the indexing means 47. Such return motion of the indexing means 47 is carried out by driving the indexing chain 51 in a reverse direction (opposite to arrow 49).

Clamping Devices 60

Figure 1C:
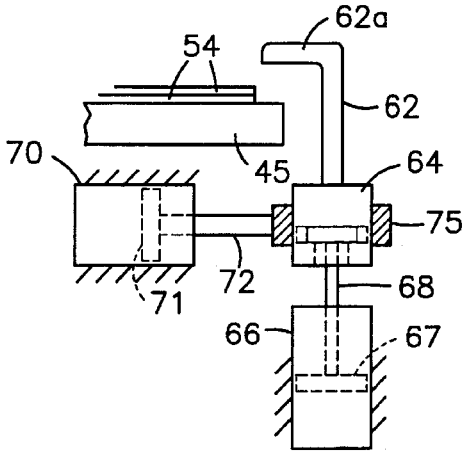
FIG. 1*c* is a sectional view taken along the line 1*c*—1*c* of FIG. 1*a*.

Each of the above-referred-to clamping devices 60, in the illustrated form best shown in FIG. 1*c*, comprises an L-shaped clamping member 62 attached to a carriage 64 that is movable in two planes. Up and down movement of the carriage 64 is effected by a first air cylinder 66 having a piston 67 and a piston rod 68 coupled to the carriage 64 through a connection that allows lateral movement of the carriage with respect to the piston rod. Side-to-side movement of the carriage 64 is effected by a second air cylinder 70 having a piston 71, a piston rod 72, and an annular coupling member 75 slidably receiving the carriage in such a manner that the carriage can move vertically with respect to the annular coupling member but is tied to the coupling member for horizontal motion.

When the L-shaped clamping member 62 is to be used for clamping one or more sections of amorphous strip to the supporting table 45, the L-shaped member is lifted to its position of FIG 1*a* by air cylinder 66, the section (or sections) 54 or 154 are placed on the table 45, the carriage 64 is driven to the left by air cylinder 70 to position upper leg 62*a* of the L-shaped member over the lateral edge of section(s) 54 and 154 and the air cylinder 66 is then operated to drive the L-shaped member 62 downward so that is upper leg 62*a* engages the top of sections(s) 54 or 154, thus clamping section(s) 54 and 154 to the table 45.

The two clamping devices 60 are substantially identical and are operated in unison. As shown in FIG. 1*a*, these clamping devices are located in spaced-apart positions along the length of the stacking zone so that they can clamp the groups 6 to the table 45 at a plurality of spaced locations, thus more effectively blocking displacement of the groups during the packet-assembly operation.

Advancing the Composite Strip 12 While the Car Clamp 22 Is Stacking a Detached Section and Is Being Reset Prior to the return of the car clamp 22 to its position of FIG. 1*a*, the-new leading edge of the remaining composite strip 12 is advanced into its dotted line position 77 shown in FIG. 4. Accordingly, when the car clamp 22 returns to its FIG. 1*a* position, the new leading portion of the composite strip 12 is ready to again be grasped by the car clamp. The car clamp accordingly grasps this new leading portion, moves to the left into a position similar to that of FIG. 3, thus advancing the composite strip into a position where it is again cut by the blades 16, 18 to detach another section 54 from the composite strip 12. This detached section is then axially advanced by leftward motion of the car clamp 22 to a position similar to that of FIG. 4. Such axial advancing motion carries the second section 54 along the length of the two sections 54 and 154 that are then clamped to the top of table 45 in the stacking zone 13. (Section 154 was derived from the other composite strip 112 and was advanced in a second-strip forward direction into its position atop the first section 54 during and immediately after the period when the car clamp 22 was being returned to its home position, as will soon be explained in more detail.) When the second section 54 enters its final, or stacking position, the clamping devices 60 are temporarily released from the two sections 54 and 154 then present in the stacking zone and are immediately thereafter applied to the edge of the second section 54, thus clamping this second section 54 to the supporting table 45 atop the previously-positioned first two sections 54 and 154.

Deriving a Section 154 from the Left-Hand Composite Strip 112 While the Right-Hand Car Clamp 22 Is Returning to Its Home Position of FIG. 1*a*; Then Stacking Section 154 upon an Already-Stacked Section 54

Figure 5:
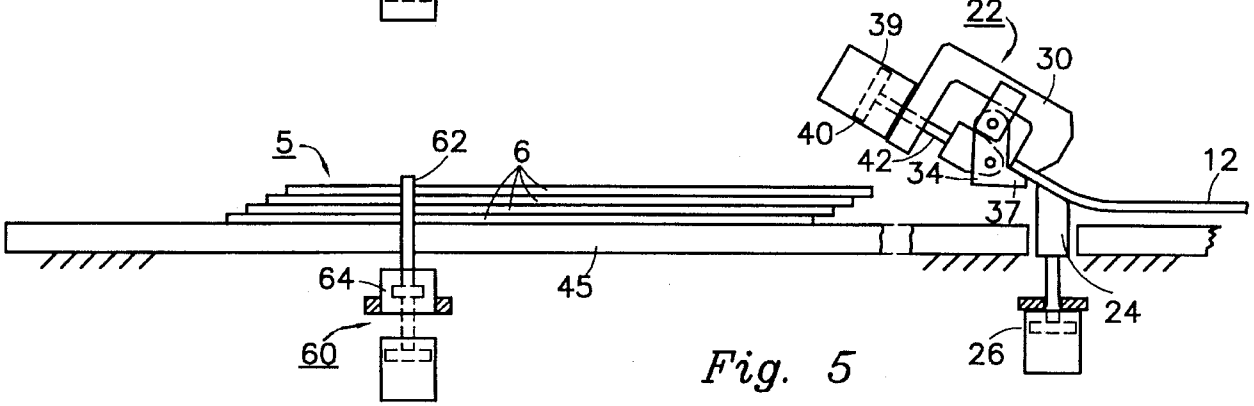
FIG. 5 is still another side-elevational view of the portion of the apparatus depicted in FIG. 1*a*. In this figure, several groups have been stacked to form a portion of a packet, and the apparatus is in readiness to advance the parent composite strip so another section of the parent composite strip may be detached therefrom and stacked upon the already-stacked groups.

While the right-hand car clamp 22 is returning to its home position of FIGS. 1*a* and 5, the other, or left-hand, car clamp 122 is pulling the other composite strip 112 forward in preparation for a cutting operation of composite strip 112. The other car clamp 122 (which serves as part of a second transport means) acts in essentially the same manner as the first car clamp 22 to grip the leading end of its associated composite strip 112, to advance the composite strip 112 forwardly into an appropriate position for cutting by shear blades 116, 118, thereby detaching a section 154 from the composite strip, and for advancing the detached section 154 into the stacking zone 13 and for stacking this section upon the sections already stacked in zone 13. After such stacking, the left hand car clamp 122 releases section 154 and returns to its home position in preparation for repeating the above-described operations. While the car clamp 122 was moving in a second-strip forward direction to effect stacking of section 154, the second strip feeding means 114*a*, 114*b* was advancing the second strip 112 forward into a position corresponding to that shown in FIG. 1*b* so that its leading end is appropriately positioned for grasping by the left-hand car clamp 122 when the car clamp returns to its home position. Movement of the left-hand car clamp 122 along the length of table 45 is controlled by indexing means 147 corresponding to the indexing means 47 for the right hand car clamp 22.

Increased Speed Resulting from Mechanisms 19 and 119 Performing Major operations Concurrently It will be apparent that the above-described packet-making operation, employing as it does two composite strips and two separate mechanisms for concurrently deriving packet components from the two composite strips and for stacking these components together to form a group, is substantially faster than that of our U.S. Pat. No. 5,063,654, which utilizes only one composite strip as the source of the packet components and employs only one of the above two mechanisms for deriving and stacking the packet components. One factor that contributes to this higher speed operation is that each of our mechanisms derives a packet component (or section) from one of the composite strips at the same time the other mechanism is being reset to its home position after having stacked a section derived from the other composite strip. Thus, at two intervals during the manufacture of each group, the two mechanisms are concurrently performing major operations. This relationship is illustrated in the timing diagram of FIG. 9. The top half of this diagram depicts the steps being performed by one mechanism 19 during an operating cycle, and the bottom half depicts the steps being performed by the other mechanism 119 during this same operating cycle. The specific steps are listed in the left-hand vertical column, and the times during which these steps are performed are depicted in the shaded blocks that are horizontally aligned with the listed steps.

It will be apparent from the second and third vertical columns of FIG. 9 that the first mechanism 19 is pulling its composite strip 12 forward and then shearing this strip 12 at the same time that the second mechanism 119 is resetting to its home position and is employing the car clamp 122 to grasp the leading end of its composite strip 112. It will also be apparent from the sixth and seventh vertical columns that the first mechanism 19 is resetting to its home position and employing its car clamp 22 to grasp the leading end of composite strip 12 at the same time that the second mechanism 119 is pulling its strip 112 forward and then shearing this strip 112.

Constructing the Composite Strips 12 and 112 from Multi-Layer Strip Derived from Master Spools 82 and 182

Figure 10:
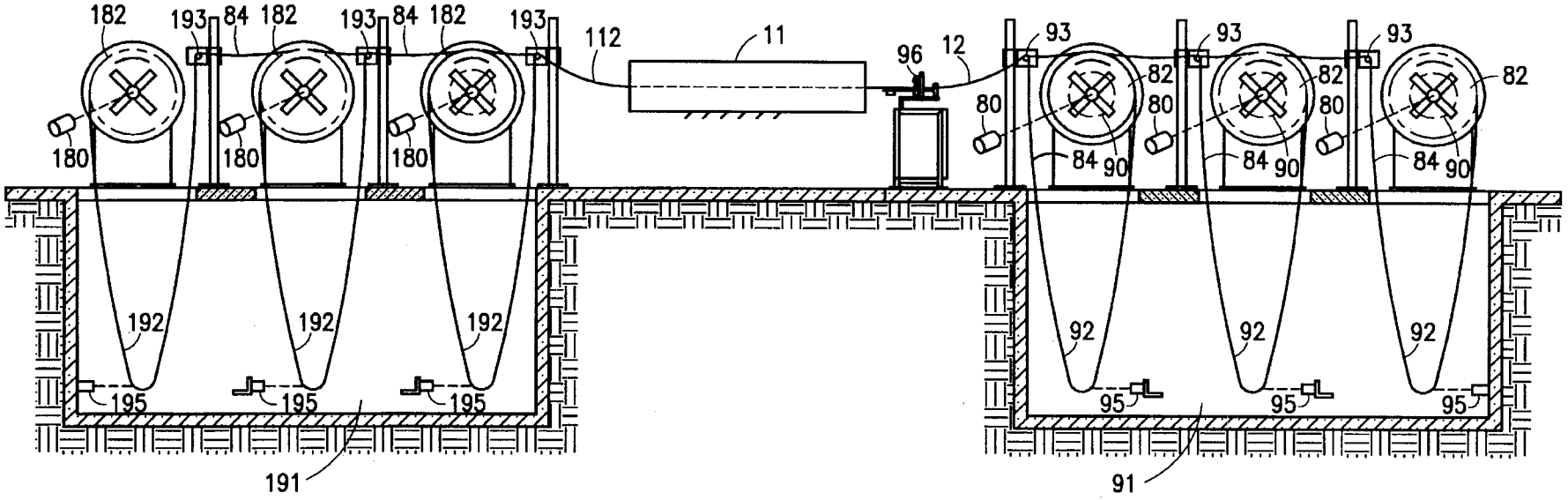
FIG. 10 is a schematic showing of a machine comprising the packet-making apparatus (11) of FIGS. 1–5 shown in block form in combination with three spools of amorphous steel strip at each side of the apparatus 11 being used to form the two composite strips that are fed into the apparatus.

Each of the above-described composite strips 12 and 112 is constructed by combining multi-layer master strip 84 unwound from a plurality of master spools, e.g., three, as illustrated in FIG. 10. Referring to FIG. 10, the packet-making apparatus of FIGS. 1–7 is illustrated in schematic block form at 11, and the master spools are shown at opposite ends of the packet-making apparatus 11. The three master spools at the right-hand side of the apparatus 11 are each designated 82, and the three at the left-hand side of this apparatus are each designated 182. In one embodiment of the invention, each of the composite strips is 15 layers thick, and each of the master strips 84 is 5 layers thick. When the three 5-layer master strips 84 are combined, a 15 layer composite strip (12 or 112) results.

The master spools 82 and 182 are preferably produced by a pre-spooling operation of the type described in Ballard and Klappert U.S. Pat. No. 5,050,294, incorporated by reference herein. This pre-spooling operation, which is not illustrated or described in detail herein, takes spools of single-layer thickness amorphous steel strip, as received from the steel mill, unwinds the strip therefrom and combines the unwound strip into a multiple-layer master strip which is wound into a master spool such as shown at 82 or 182.

Each set of master spools 82 and 182 is operated in the basic manner disclosed in the aforesaid Ballard and Klappert U.S. Pat. No. 5,050,294, to form the composite strips 12 and 112, respectively. Since each set of master spools is operated in basically the same manner, the operation of only one set, the right-hand set 82, will be described in detail herein. Proceeding with this description, the master spools of set 82 are loaded on rotatable payoff reels 90, and the master strips therefrom are unwound from these spools and caused to travel into a location where they are combined to form the composite strip 12.

In unwinding from their master spools and traveling into the locations where they are combined to form the composite strip 12, each of the master strips 84, passes through a pit 91 common to and beneath all the master spools 82 and then over a guide roll 93 where the orientation of each strip is changed from generally vertical to generally horizontal. After passing over the guide rolls 93, the master strips 84 are combined into the composite strip 12. The portion of each multi-layer master strip 84 between its associated master spool 82 and its guide roll 93 hangs downwardly in a loop 92 that is located in the pit 91. The weight of the strip 84 in this loop 92 exerts tensile forces on the associated strip 84 as it enters the composite strip 12, thus keeping the strip 84 taut just upstream from the location where it is combined with the other strips 84, thus reducing the chances for wrinkles and other irregularities in the composite strip.

For controlling unwinding of the master spools 82 in the apparatus of FIG. 10, each of the payoff reels is coupled to the rotor of an electric motor 80. As the composite strip 12 is fed to the left the motor rotates its associated payoff reel in a clockwise direction, as shown by arrow 81, making unwound strip material available for the composite strip 12. As noted hereinabove, in the pit 91 beneath each master spool 82 the strip unwound from each master spool hangs down into a loop 92. Each of the individual strips forming the multiple-layer strip hangs down in its own loop (as shown in FIG. 2 of U.S. Pat. No. 5,050,294), and the vertical spacing between these loops becomes increasingly larger as the associated master spool unwinds. A photoelectric control 95 for each multiple-layer strip 84 is located within, or adjacent, the pit 91 and operates off the lowermost loop of each multiple-layer strip 84 (i) to cause the motor 80 associated with that strip 84 to start and unwind the strip at gradually increasing speed if the loop rises above a predetermined upper limit and (ii) to cause the motor to decelerate to a stop if the loop falls below a predetermined lower limit.

Referring to FIG. 1*a*, the two strip-feeding means 22 and 14, in moving to the left, cause the composite strip 12 to be intermittently advanced to the left; and this causes the horizontal portions of the multi-layer strips 84 to be advanced intermittently to the left. As the horizontal portions of the strips 84 are thus intermittently advanced to the left, the master spools 82 are unwound by their respective motors 80, making available strip material in the loops 92. From these loops the multi-layer strip material 84 is pulled by feed means 22 and 14 and combined into the composite strip 12. During these operations, the horizontal portion of each of the multi-layer strips 84 is maintained under tension by the weight of the loops 92 in the pit 91.

As noted above, the left-hand master spools 182 are operated in basically the same way as the right-hand master spools 82 to form one of the composite strips (112). It will be noted that each of the master spools 182 is unwound by rotation in a counter clockwise direction 181, as contrasted with the clockwise direction used for unwinding the right-hand spools 82.

Additional Advantages of This Double-Pull Method over the Prior Single Pull Method Another advantage of the present method over that of our U.S. Pat. No. 5,063,654 is that the present method enables us to use the strip from a greater number of spools for making each group (6). In the method of U.S. Pat. No. 5,063,654, the composite strip used for making each of the two sections of a group (6) is derived from the same set of master spools. But in the present method the composite strip (12) used for making one section 54 of a group is derived from a different set of master spools than the composite strip (112) that is used for making the next section 154 of the group.

Using our present method to construct a 30-strip group, we can source the 30 strips from up to 30 different spools of single-layer strip from the steel mill. But using the method of U.S. Pat. No. 5,063,654 to construct a 30 -strip group, where each half (or section) of a group is derived from the same set of three master spools, we are limited to a maximum of 15 different spools of single-layer strip from the steel mill as the source for the strips making up a group. Being able to use a greater number of mill (or original) spools as the source for each group allows us to achieve a significantly better averaging effect both in respect to core losses and core cross-section.

Figure 11:
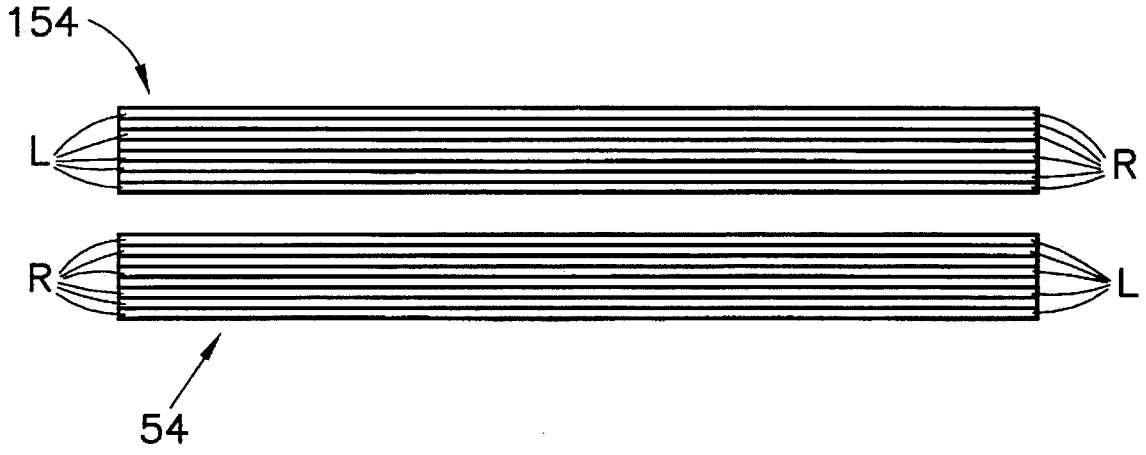
FIG. 11 is a schematic enlarged end view showing two sections of amorphous strip just prior to stacking.

Another feature that enables us to achieve an improved cross-section for the core is that the spools 182 at the left-hand side of the core-making apparatus 11 are axially reversed with respect to the spools 82 at the right-hand side of the core-making apparatus. Note in this regard that the amorphous steel strip material received from the steel mill has a distinct left-hand edge and a distinct right-hand edge as related to the usual apparatus that is used for making the amorphous strip. (For example, the strip may be slightly thicker at one edge than the other.) When multiple spools of this strip steel as received from the mill are combined through the above-referred-to pre-spooling process of U.S. Pat. No. 5,050,294 to form master spools 82 and 182, the master strip on these master spools has a distinct left hand edge (where all the left-hand edges of the original strips are located). When these master spools 82 and 182 are deployed as depicted in FIG. 10, the master spools 82 at one side of apparatus 11 are axially reversed from the master spools 182 at the other side of apparatus 11. As a result, the left-hand edge of the original strip in master spools 82 is closest to the viewer as depicted in FIG. 10, and the right-hand edge of the original strip in master spools 182 is closest to the viewer as depicted in FIG. 10. The result of this is that when sections 54 and 154 are combined, the right-hand edges of the original strip material in each section 54 are closest to the left-hand edges of the original strip material in the adjacent section 154. This relationship is illustrated in FIG. 11 where two sections 54 and 154 are shown in end view just before being stacked together. The right-hand edges of the original strip in the two sections are designated R, and the left-hand edges of this original strip are designated L. If the right-hand edge of the strip material is slightly thicker than the left, there is no build-up in thickness of the group at one edge over the other since the total number of right-hand and left-hand edges of the original strip at one edge of the group is equal to the this same total at the other edge of the group.

Shifting Between a Double-Pull Mode of Operation and a Single-Pull Mode

Although the illustrated machine normally operates in what can be called a double-pull mode, which involves alternately deriving sections (54 and 154) from the two composite strips 12 and 112 and stacking these sections in alternating relationship upon one another, the machine can be controlled to operate with just one composite strip (12 or 112) as the source of the sections. In this regard, in case the reels 90 or 190 at one side of the apparatus 11 run out of strip material, then the machine will function as a single-pull machine, deriving all of the sections from the spools at only one side of the apparatus 11. In other words, the machine converts in this situation from its normal double-pull mode of operation to a single-pull mode of operation. As soon as the previously-exhausted reels at one side have been reloaded, the machine is restored to its normal double-pull mode of operation. This ability to shift between double-pull and single-pull and back again reduces down-time of the machine. This shifting is controlled by a computer (not shown) which tracks the operation of the machine components and knows the status and position of each pull sequence.

Concurrently Operating the Two Strip-Handling Mechanisms 19 and 119 in a Single-Pull Mode Another way in which the illustrated machine can be operated is by concurrently operating each of the strip-handling mechanisms 19 and 119 in a single-pull mode so as to concurrently produce (at spaced locations within the stacking zone 13) two packets that are respectively dimensioned for sequential wrapping in superposed relationship about the arbor of the belt-nesting device. The strip-handling mechanisms 19 and 119 are controlled in such a manner that the second-to-be-wrapped packet is made longer than the first-to-be-wrapped packet by an amount that is sufficient to allow the longer packet to be wrapped completely about the outer periphery of the first-wrapped packet. In one embodiment, each successive group in each of the two packets is made longer than the immediately-preceding group by an amount $2\pi T$, where T is the thickness of the immediately-preceding group; and in the second packet, the first group is made longer than the last group of the first packet by an amount $2\pi T$, where T is the thickness of the last group of the first packet.

As noted hereinabove, the two sections (54 and 154) constituting each group may be of the same length, but in a preferred form of the invention, the outer section is made longer than the inner section by an amount $2\pi T$, where T is the thickness of the inner section. In this form of the invention, the inner section of the next succeeding group is made longer than the outer section, of the immediately-preceding group by an amount $2\pi T$, where T is the thickness of said outer section. Thus, in this packet, proceeding radially outward, each section is longer than the immediately-preceding section by an amount $2\pi T$, where T is the thickness of the immediately preceding section. This type of construction is disclosed in more detail and claimed in Freeman application Ser. No. 07/904,746, which issued as U.S. Pat. No. 5,329,270 and is incorporated by reference herein.

Manufacturing the packets in either of the above manners constitutes one operating cycle of the machine. This operating cycle is repeated over and over again until a sufficient number of packets have been made to enable a complete core form to be constructed from the packets. After each cycle, the two packets produced by the cycle are wrapped in succession and in superposed relationship about the previously-wrapped portion of the core form. After each pair of packets has been wrapped, the joints within each of the packets are examined, and appropriate adjustments can be made in the length of the next two packets should there be any need for such adjustments, e.g., to provide properly-dimensioned joints at the ends of succeeding groups.

The single-pull mode of operation that we have described in the above three paragraphs can be employed only if the stacking zone 13 of the apparatus 11 is long enough to allow two packets to be concurrently assembled thereon at spaced-apart locations. Accordingly, the principal application of this alternate single-pull method is for manufacturing cores of relatively small diameter in which the packet length is small enough to permit concurrent assembly at spaced locations in stacking zone 13 of pairs of the packets used in the core.

Of course, the machine can be adapted or designed for the manufacture of larger cores by this single-pull mode by providing a longer table 45 that results in a longer stacking zone 13, providing sufficient space for longer packets to be assembled concurrently.

The core-making machine 11 is controlled during the single-pull mode of operation by the same computer (not shown) as referred to in the preceding section of this application. This computer tracks the operation of the machine components and knows the parameters of each pull sequence. A suitable control (not shown) initiates operation of the machine in this single-pull mode when the packets for relatively small cores are to be made and returns the machine to its normal mode of operation when the packets for larger cores are to be made.

Figure 12:
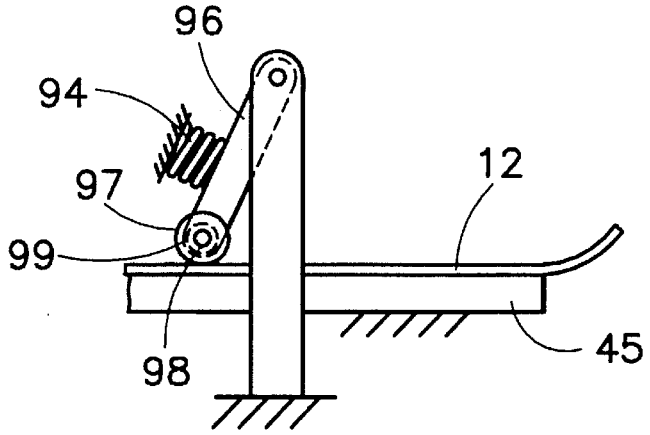
FIG. 12 is an enlarged, partially schematic, side elevational view of an anti-backtracking mechanism present in the machine of FIG. 10.

Preventing the Leading End of Composite Strip 12 From Sliding out of the Machine Should the Pull-to-Length Mechanism Fail Should the pull-to-length mechanism comprising car-clamp 22 fail, the leading end of the composite strip 12 would have a tendency to slide out of the machine and fall into the loop pit 91. This is undesirable because much time would be required to retrieve the leading end and re-thread it into the machine. To prevent this situation from occurring, pivotally-mounted hold-down arm 96 is provided at the right-hand end of apparatus 11. Referring to the more detailed showing of FIG. 12, a roller 97 mounted on shaft 98 at the distal end of the arm has a non-slip outer periphery that is pressed against the strip 12 by a spring 94. As a result of the frictional contact between the outer periphery and the strip 12, the roller 97 is forced to roll in a clockwise direction as the strip 12 is fed to the left. A one-way bearing 99 between the roller 97 and the shaft 98 prevents the roller from rolling in a counter-clockwise direction, thus preventing movement of the composite strip 12 to the right so long as the roller 97 is pressed thereagainst.

A substantially identical one-way roller mechanism is provided at the opposite end of apparatus 11 for cooperating with the other composite strip 112 to prevent its leading end from sliding out of the machine should there be a failure in the pull-to-length mechanism comprising car clamp 122.

While we have shown and described a particular embodiment of our invention, it will be obvious to those skilled in the art that various changes and modifications may be made without departing from our invention in its broader aspects; and we, therefore, intend herein to cover all such changes and modifications as fall within the true spirit and scope of our invention.

What we claim as new and desire to secure by Letters Patent of the United States is:

1. Apparatus for making packets of amorphous metal strip adapted to be wrapped about the arbor of a transformer-core-making machine, each packet comprising a plurality of superposed groups of strip, each group comprising one or more sections and each section including many thin layers of strip, comprising:

(a) support means providing a stacking zone where the packets are built up during a packet-making operation, and means for providing first and second composite strips, each comprising many thin layers of amorphous metal strip stacked in superposed relationship, the composite strips having leading ends that are located in initial positions that are axially spaced from each other at the start of a packet-making operation, the initial positions being at opposite ends of said stacking zone, (b) means for advancing the leading end of said first multi-layer composite strip from its initial position in a first-strip forward direction, (c) means operable after the advancing action of paragraph (b) for cutting said first multi-layer composite strip at a first cutting location spaced rearwardly of the leading edge of said first composite strip, thereby detaching from said leading end of said first composite strip a first section of multi-layer amorphous metal strip and also creating a new leading end of said first composite strip just behind said first cutting location, (d) means for axially advancing said first detached section in said first-strip forward direction to a position axially spaced from said first cutting location and within said stacking zone, (e) means for advancing the leading end of said second multi-layer composite strip from its initial position in a second-strip forward direction that is opposite to said first-strip forward direction, (f) means operable after the advancing action of paragraph (e) for cutting said second multi-layer composite strip at a second cutting location spaced rearwardly of the leading edge of said second composite strip, thereby detaching from said leading end of said second composite strip a second section of multi-layer amorphous metal strip and also creating a new leading end of said second composite strip just behind said second cutting location, (g) means for axially advancing said second detached section in a second-strip forward direction into a position within said stacking zone atop said first detached section, and in which:

(h) the means defined in paragraphs (b) and (d) comprises first transport means that is moved from a home position in said first-strip forward direction during the advancing actions defined in paragraphs (b) and (d) and thereafter is returned in an opposite direction to said home position in preparation for advancing the new leading end of said first composite strip in said first-strip forward direction, (i) the means of paragraph (e) performs the advancing action defined in paragraph (e) concurrently with said return motion of said first transport means to said home position, and (j) the apparatus acts to effect additional cutting of said composite strips to detach additional sections of multi-layer amorphous metal strip from said composite strips and to effect stacking of said additional sections upon said first and second sections in said stacking zone until a predetermined number of said sections have been stacked upon said first and second sections to form a packet.

2. Apparatus as defined in claim 1 and in which:

(a) the means defined in paragraphs (e) and (g), claim 11, comprises second transport means that is moved from a second home position in said second-strip forward direction during the steps of (e) and (g), claim 1, and thereafter is returned in an opposite direction to said second home position in preparation for advancing the new leading end of said second composite strip in said second-strip forward direction, and (b) the new leading end of said first composite strip is advanced in said first-strip forward direction concurrently with said return motion of said second transport means.

3. Apparatus for making packets of amorphous metal strip adapted to be wrapped in superposed relationship about the arbor of a transformer-core-making machine, each packet comprising a plurality of groups of strip, each group comprising many thin layers of strip, each layer having two longitudinally-extending edges at opposite sides of the layer and two transversely-extending edges at opposite ends of the layer, the longitudinally-extending edges at each side of the layers of each group being substantially aligned and the transversely-extending edges at each end of the layers in each group being in near-alignment, said apparatus comprising:

(a) support means providing a stacking zone where the packets are built up during a packet-making operation, and means for providing first and second composite strips, each comprising many thin layers of amorphous metal strip stacked in superposed relationship, the composite strips having leading ends that are located in initial positions that are axially spaced from each other at the start of a packet-making operation, the initial positions being at opposite ends of said stacking zone, (b) means for cutting said composite strips to detach first sections of multi-layer amorphous metal strip from said first composite strip and to detach second sections of multi-layer amorphous metal strip from said second composite strip, and means for axially advancing said detached sections forwardly of the respective composite strips from which they are detached into said stacking zone, (c) means for stacking said second sections in alternating relationship upon said first sections in said stacking zone, and in which:

(d) the means for advancing each of said first sections into said stacking zone comprises first transport means that is moved in a first-strip forward direction during said advancing of each said first section and is returned to a home position in preparation for each succeeding advancing operation of a first section, (e) the means for advancing each of said second sections into said stacking zone comprising second transport means that is moved in a second-strip forward direction opposite to said first-strip forward direction during said advancing of each of said second sections and is returned to its own home position in preparation for each succeeding second-section advancing operation, (f) each group is formed from one or more of said sections with the layers of each group stacked in near alignment, and (g) the leading edges of the stacked sections are located when stacked in positions that locate the adjacent transversely-extending edges of adjacent groups in staggered relationship with respect to each other.

4. Apparatus as defined in claim 3 and in which:

(a) each of the second-section advancing operations of paragraph (e), claim 3, is performed concurrently with said return motion of said first transport means toward its home position, and (b) each of the first-section advancing operations of paragraph (d), claim 3, is performed concurrently with said return motion of said second transport means toward its home position.

5. Apparatus as defined in claim 3 and having an additional mode of operation in which the apparatus is operable instead of in the mode defined in paragraphs (c) through (g) of claim 3, and in said additional mode of operation:

(a) the sections detached from each composite strip are stacked upon one another in separate locations within said stacking zone, thereby building up packets in said separate locations that are respectively derived from said two composite strips, and (b) concurrent build-up is effected in said stacking zone of pairs of packets that are successively wrapped about the arbor of said transformer-core making machine.

* * * * *